US011046918B2

(12) United States Patent
Piorkowski et al.

(10) Patent No.: US 11,046,918 B2
(45) Date of Patent: Jun. 29, 2021

(54) DEFOAMING SYSTEMS FOR UNIT DOSE DETERGENTS

(71) Applicant: Henkel IP & Holding GmbH, Duesseldorf (DE)

(72) Inventors: Daniel Thomas Piorkowski, Fairfield, CT (US); Carolyn Greer Mastriano, North Branford, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 12 days.

(21) Appl. No.: 16/552,766

(22) Filed: Aug. 27, 2019

(65) Prior Publication Data

US 2021/0062112 A1 Mar. 4, 2021

(51) Int. Cl.

| | |
|---|---|
| ***C11D 17/04*** | (2006.01) |
| ***C11D 3/20*** | (2006.01) |
| ***C11D 3/37*** | (2006.01) |
| ***C11D 3/386*** | (2006.01) |
| ***C11D 1/72*** | (2006.01) |

(52) U.S. Cl.

CPC ..... *C11D 3/2082* (2013.01); *C11D 1/72* (2013.01); *C11D 3/373* (2013.01); *C11D 3/386* (2013.01); *C11D 17/042* (2013.01)

(58) Field of Classification Search

CPC ..... C11D 3/3707; C11D 3/373; C11D 1/72; C11D 1/722; C11D 17/042

See application file for complete search history.

(56) References Cited

U.S. PATENT DOCUMENTS

| | | | | |
|---|---|---|---|---|
| 2008/0058244 | A1 | 3/2008 | Sunder et al. | |
| 2016/0355755 | A1* | 12/2016 | Brooker | C11D 3/30 |
| 2018/0216033 | A1 | 8/2018 | Camire et al. | |
| 2018/0334641 | A1 | 11/2018 | Piorkowski | |
| 2019/0048296 | A1 | 2/2019 | Pirokowski | |
| 2019/0127669 | A1 | 5/2019 | Piorkowski et al. | |

FOREIGN PATENT DOCUMENTS

| | | | |
|---|---|---|---|
| EP | 0008142 | A1 | 2/1980 |
| WO | 9933943 | A1 | 7/1999 |
| WO | 2015065805 | A1 | 5/2015 |

OTHER PUBLICATIONS

International Searching Authority, PCT International Search Report and the Written Opinion of the International Searching Authority, dated Dec. 23, 2020, pp. 3-9, PCT/US2020/048193, International Application Division, Korean Intellectual Property Office, Daejeon, Republic of Korea.

* cited by examiner

*Primary Examiner* — John R Hardee
(74) *Attorney, Agent, or Firm* — Bojuan Deng

(57) ABSTRACT

A detergent composition and a unit dose detergent pack are provided. In one example, the detergent composition includes a surfactant. A fatty acid is present in an amount of from about 0.1 wt. % to about 3 wt. % of the detergent composition. A silicone is present in an amount of from about 0.005 wt. % to about 0.2 wt. % of the detergent composition. One or more non-aqueous solvents is selected from the group of polyethylene glycol (PEG), glycol ether, poloxamer, and reverse poloxamer. The one or more non-aqueous solvents is present in an amount of from about 5 wt. % to about 25 wt. % of the detergent composition.

20 Claims, 5 Drawing Sheets

DEFOAMING SYSTEMS FOR UNIT DOSE DETERGENTS

FIELD OF THE INVENTION

The technical field relates generally to detergents and more particularly, relates to detergent compositions, unit dose detergent packs containing such compositions, and methods for making such unit dose detergent packs.

BACKGROUND OF THE INVENTION

Unit dose detergent packs are detergents that have been packaged into single dose portions. These unit dose detergent packs offer the benefits of, for example, convenience of use and dispensing and avoiding or minimizing direct skin contact with potentially irritating cleaning compositions as compared to detergents that have not been packaged into single dose portions. The detergent in unit dose detergent packs is usually contained within a water-soluble or water-dispersible film. As such, the detergent contained within the film often is limited to having low water levels as to prevent the film from being dissolved or dispersed pre-maturely by the detergent composition. Detergent compositions having water levels that are too high may make it difficult to maintain pack firmness of the unit dose detergent pack and make the pack more prone to leakage or breakage. However, water is an inexpensive ingredient in detergents and is also a ubiquitous solvent. As such, increasing the amount of water in detergents while maintaining pack firmness and preventing leakage and breakage of the unit dose detergent pack is desirable.

Fatty acids are commonly used in detergent compositions and provide a de-foaming quality to the detergent and stability to the unit dose detergent pack. However, fatty acids are a costly component(s) to detergents. As such, reducing the amount of fatty acids in detergents while maintaining de-foaming and stability qualities of the unit dose detergent packs is desirable.

Accordingly, it is desirable to provide a detergent composition and a unit dose detergent pack that addresses one or more of the foregoing issues. Furthermore, other desirable features and characteristics of the various embodiments described herein will become apparent from the subsequent detailed description and the appended claims, taken in conjunction with the accompanying drawings and this background.

BRIEF SUMMARY OF THE INVENTION

A detergent composition and a unit dose detergent pack are provided herein. In accordance with an exemplary embodiment, the detergent composition includes a surfactant. A fatty acid is present in an amount of from about 0.1 wt. % to about 3 wt. % of the detergent composition. A silicone is present in an amount of from about 0.005 wt. % to about 0.2 wt. % of the detergent composition. One or more non-aqueous solvents is selected from the group of polyethylene glycol (PEG), glycol ether, poloxamer, and reverse poloxamer. The one or more non-aqueous solvents is present in an amount of from about 5 wt. % to about 25 wt. % of the detergent composition.

In accordance with an exemplary embodiment, the unit dose detergent pack includes a container formed of a water-soluble and/or a water-dispersible material. A detergent composition is disposed in the container. The detergent composition includes a fatty acid present in an amount of from about 0.1 wt. % to about 3 wt. % of the detergent composition. A silicone is present in an amount of from about 0.005 wt. % to about 0.2 wt. % of the detergent composition. One or more non-aqueous solvents is selected from the group of polyethylene glycol (PEG), glycol ether, poloxamer, and reverse poloxamer. The one ore more non-aqueous solvents is present in an amount of from about 5 wt. % to about 25 wt. % of the detergent composition. Water is present in an amount of from about 8 wt. % to about 25 wt. % of the detergent composition.

BRIEF DESCRIPTION OF THE DRAWINGS

The various embodiments will hereinafter be described in conjunction with the following drawing figures, wherein like numerals denote like elements, and wherein.

DETAILED DESCRIPTION OF THE INVENTION

Figure 1:
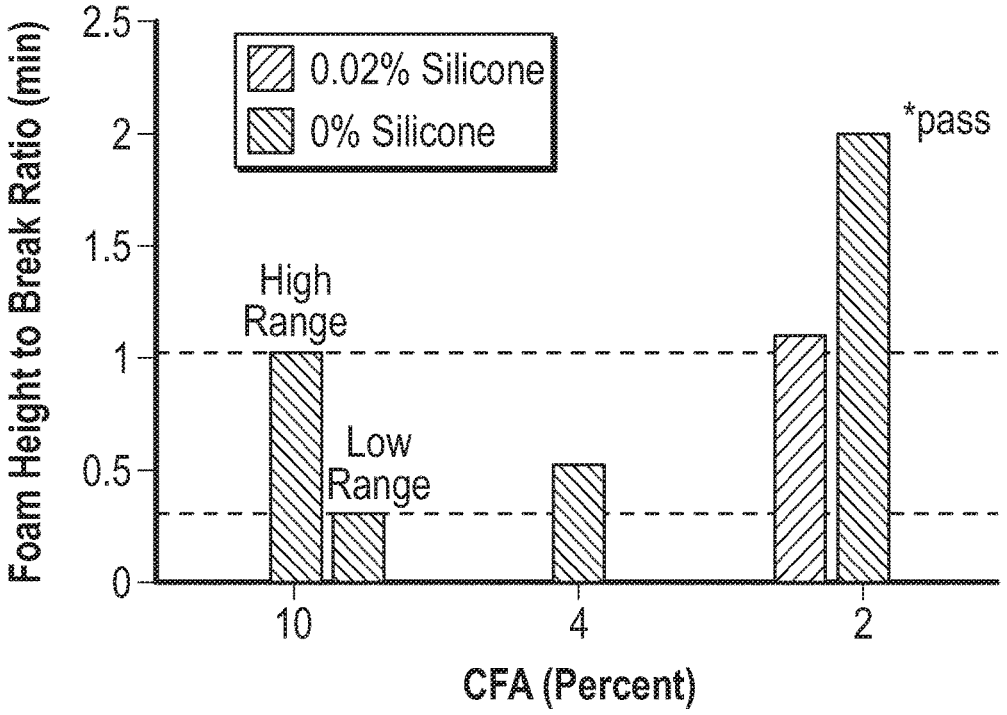
FIG. 1 illustrates a graphical representation of foam height to foam break ratio data for various detergent compositions in accordance with an exemplary embodiment.
Figure 2A:
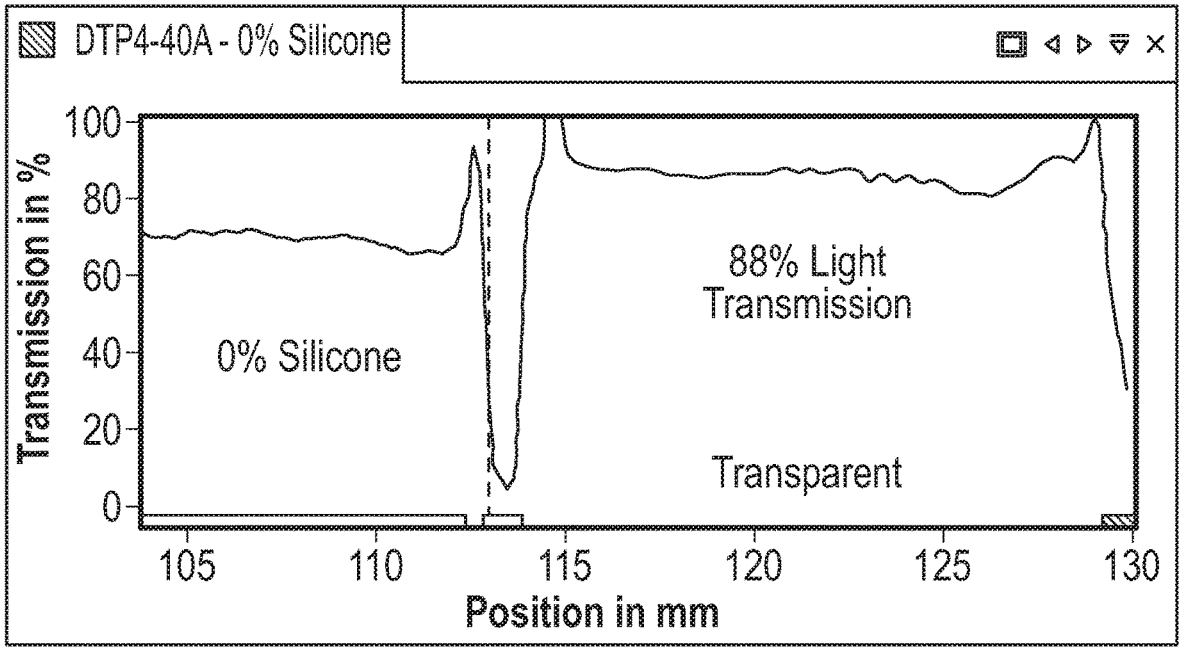
FIGS. 2A-2H illustrate graphical representations of light transmission data for various detergent compositions in accordance with exemplary embodiments.
Figure 2B:
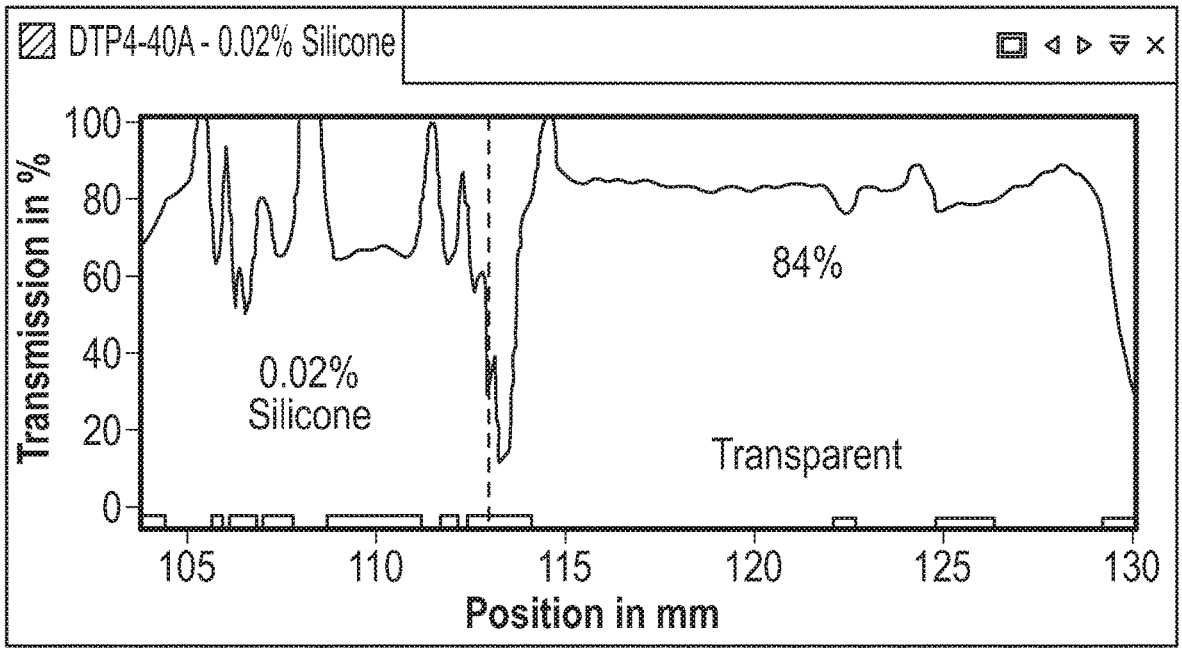
Figure 2C:
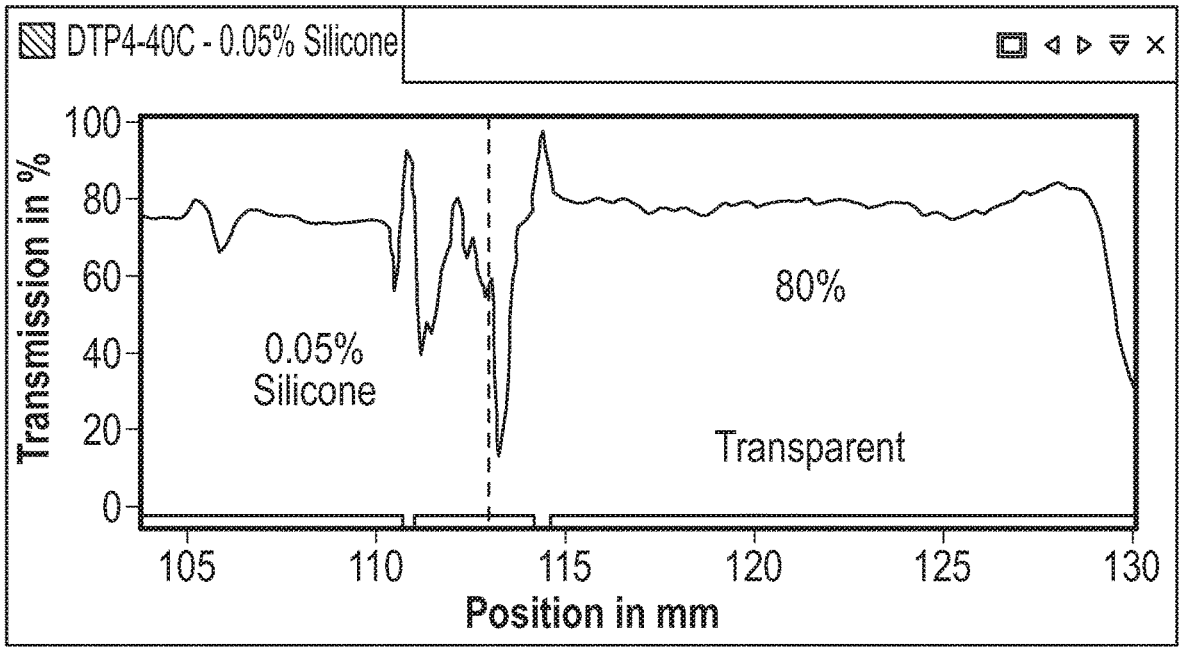
Figure 2D:
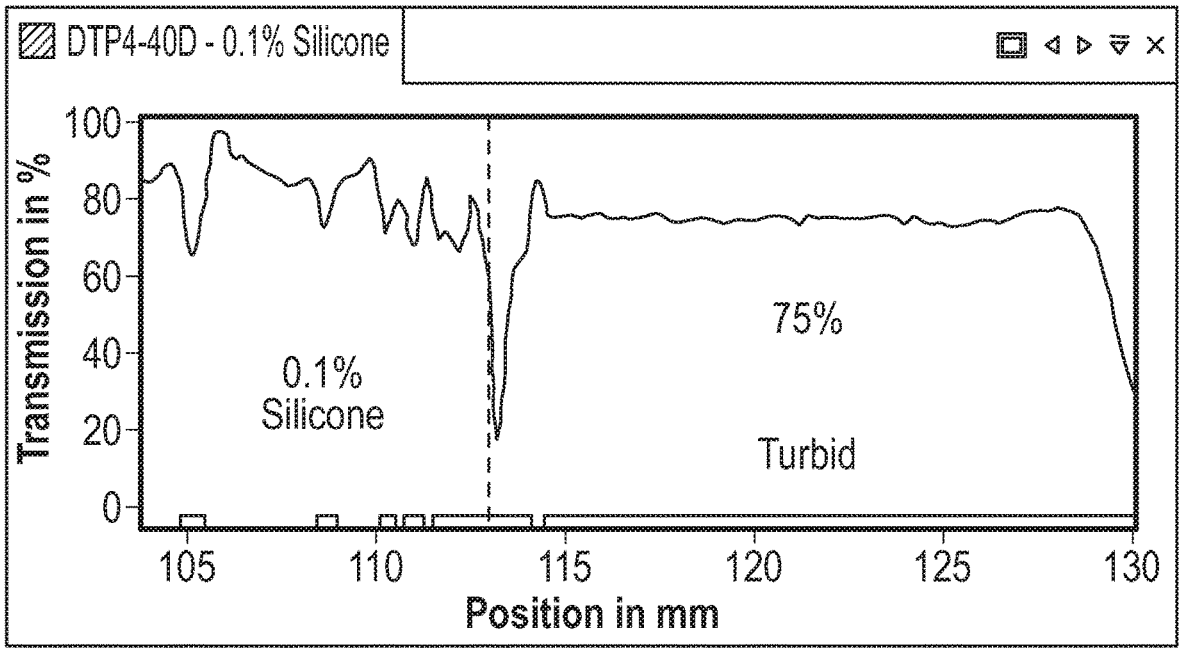
Figure 2E:
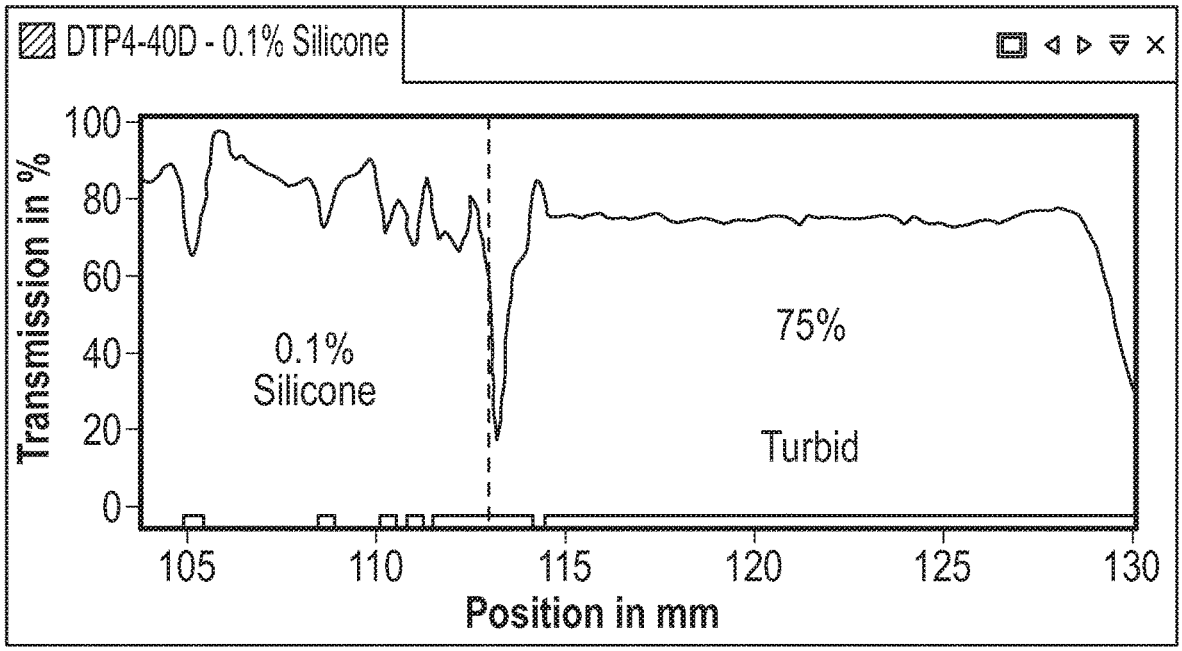
Figure 2F:
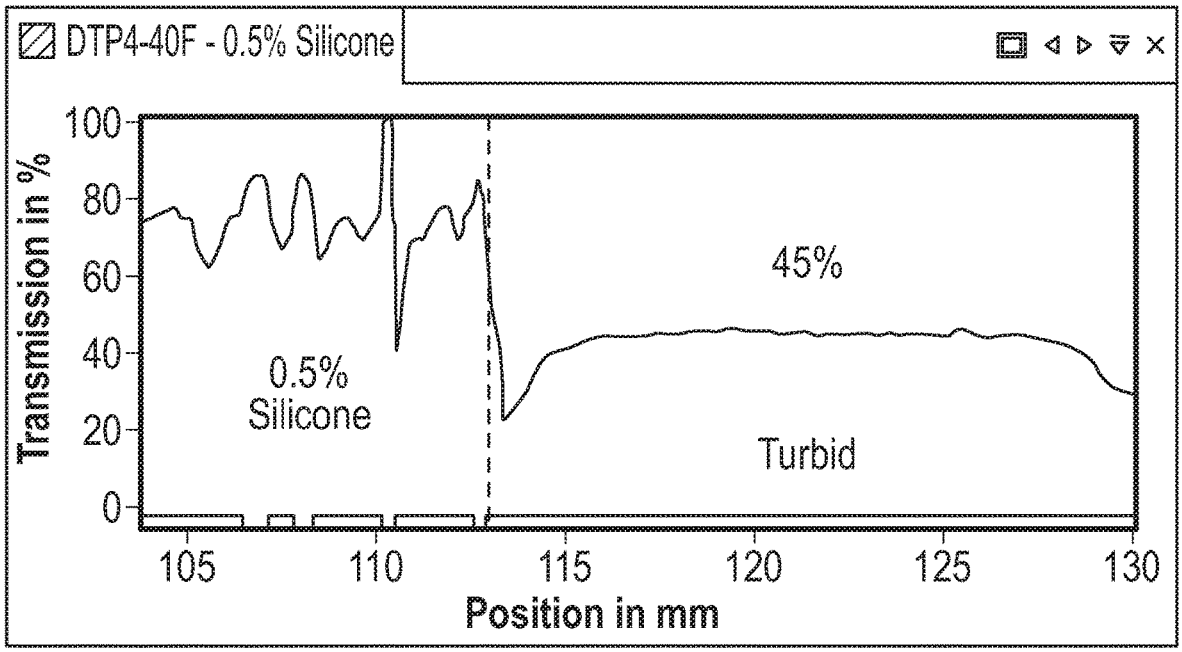
Figure 2G:
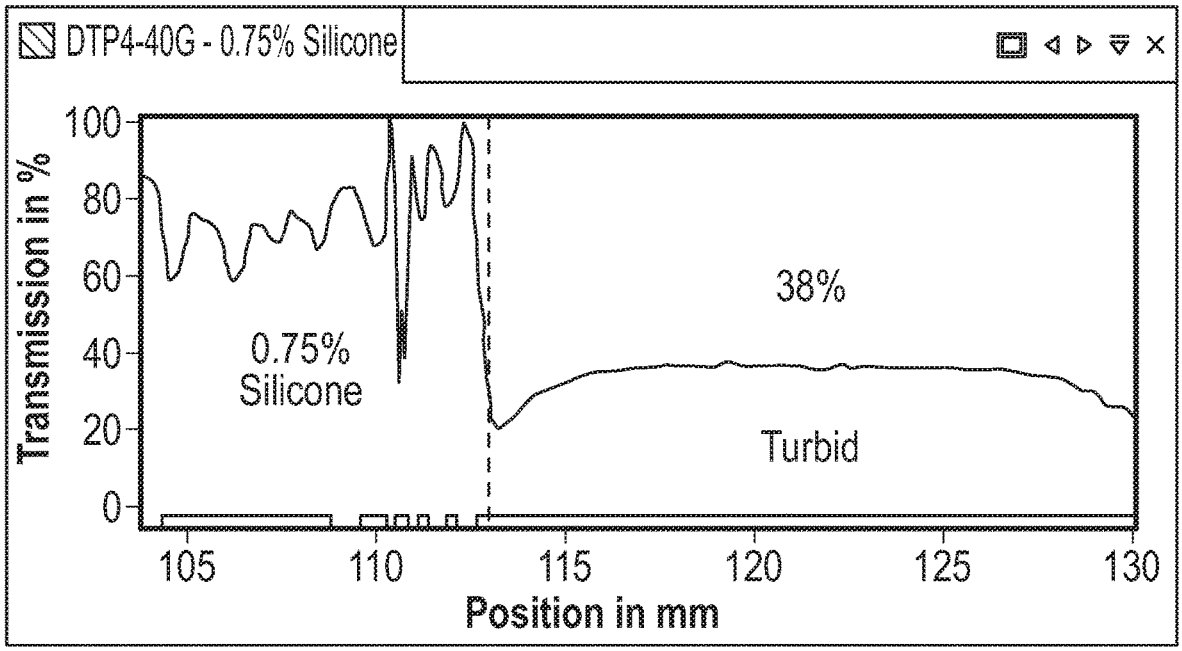
Figure 2H:
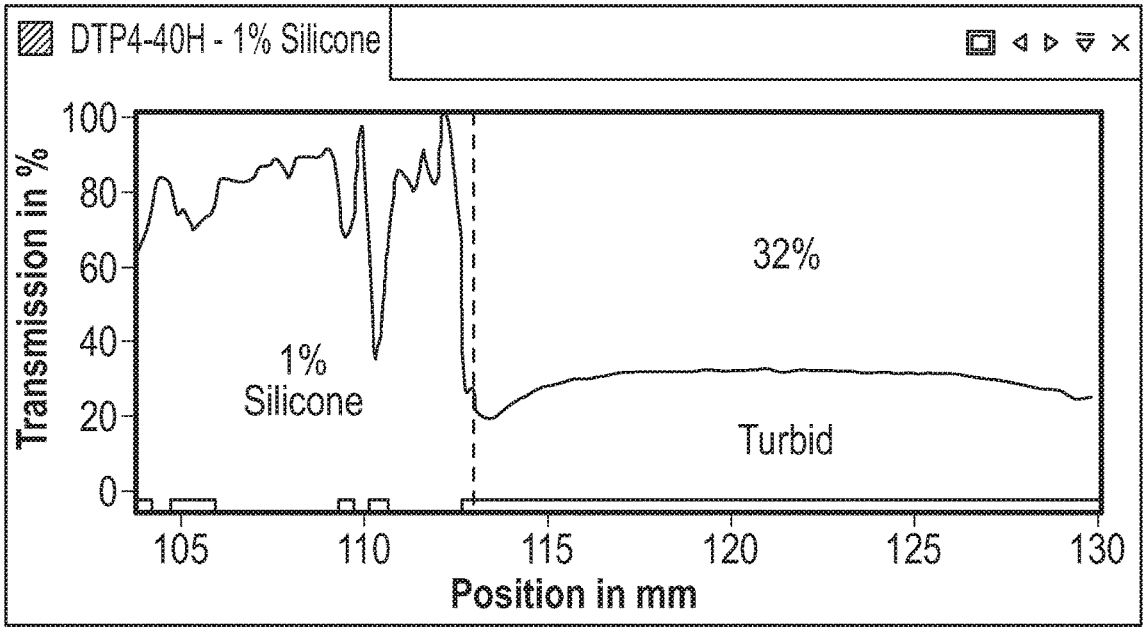

The following Detailed Description is merely exemplary in nature and is not intended to limit the various embodiments or the application and uses thereof. Furthermore, there is no intention to be bound by any theory presented in the preceding background or the following detailed description.

Various embodiments contemplated herein relate to detergent compositions and unit dose detergent packs. The exemplary embodiments taught herein provide a unit dose detergent pack including a container and a detergent composition encapsulated by or otherwise disposed in the container. In an exemplary embodiment, the container is formed of a water-soluble and/or a water-dispersible material. The detergent composition includes a fatty acid that is present in an amount of from about 0.1 wt. % to about 3 wt. % of the detergent composition. A silicone is present in an amount of from about 0.005 wt. % to about 0.2 wt. % of the detergent composition. One or more non-aqueous solvents are selected from the group of polyethylene glycol (PEG), glycol ether, poloxamer, and reverse poloxamer. The one or more non-aqueous solvents is present in an amount of from about 5 wt. % to about 25 wt. % of the detergent composition. Water is present in an amount of from about 8 wt. % to about 25 wt. % of the detergent composition. In an exemplary embodiment, the detergent composition has relatively low fatty acid content and maintains a water content within a desirable range. Advantageously, the silicone enhances the de-foaming performance of the detergent composition while the one or more non-aqueous solvents helps to maintain the pack stability of the unit dose detergent pack. In an exemplary embodiment, by including the silicone in combination with the one or more non-aqueous solvents in the detergent composition, the fatty acid content of the detergent composition can be decreased while maintaining pack firmness, de-foaming performance, and stability of the unit dose detergent pack.

In an exemplary embodiment, the detergent composition includes at least one surfactant. Non-limiting examples of surfactants include linear alkylbenzene sulfonates (LAS), alcohol ethoxysulfates (AES), and/or non-ionic surfactants.

Linear alkylbenzene sulfonates (LAS) are water-soluble salts. In an exemplary embodiment, the linear alkyl group of the LAS has from an 8 to 22 carbon atom chain. The LAS can be an alkali metal salt, an ammonium salt, an alkylammonium salt, or alkanolammonium salt. In an exemplary embodiment, the LAS is an alkali metal salt of a $C_{10}$-$C_{16}$ alkyl benzene sulfonic acid, such as a $C_{11}$-$C_{14}$ alkyl benzene sulfonic acid. In an exemplary embodiment, the LAS is a sodium and/or a potassium linear, alkylbenzene sulfonate in which the average number of carbon atoms in the alkyl group is from 11 to 14. In an exemplary embodiment, the LAS is sodium $C_{11}$-$C_{14}$ (e.g., $C_{12}$).

Alcohol ethoxysulfates (AES), also known as alkyl ether sulfates or alkyl polyethoxylate sulfates, are compounds having Formula (I):

$$R_1—O—(C_2H_4O)_n—SO_3M \qquad \text{Formula (I)},$$

wherein $R_1$ is a $C_8$-$C_{22}$ alkyl group, n is an integer from 1 to 20, and M is a salt-forming cation. In an exemplary embodiment, $R_1$ is a $C_{10}$-$C_{18}$ alkyl group, such as a $C_{10}$-$C_{15}$ alkyl group, n is an integer from 1 to 15, such as 1 to 10, for example, 1 to 8, and M is sodium, potassium, ammonium, alkylammonium, or alkanolammonium. In an exemplary embodiment, $R_1$ is a $C_{12}$-$C_{16}$ alkyl group, n is an integer from 1 to 6, and M is sodium. In an exemplary embodiment, the AES is sodium lauryl ether sulphate (SLES). In an exemplary embodiment, the AES is used in the form of mixtures including varying $R_1$ chain lengths and varying degrees of ethoxylation. Such mixtures may inevitably also contain some unethoxylated alkyl sulfate materials, i.e., n=0 in the above Formula (I).

Unethoxylated alkyl sulfates may also be added separately to the aqueous surfactant system of present disclosure and used as or in any anionic surfactant component that may be present. In an exemplary embodiment, unalkoyxylated, e.g., unethoxylated, alkyl ether sulfate surfactants are those made by the sulfonation of higher $C_8$-$C_{20}$ fatty alcohols. In an exemplary embodiment, the unethoxylated alkyl sulfate is a compound having Formula (II):

$$R_2—O—SO_3M \qquad \text{Formula (II)},$$

wherein $R_2$ is a $C_8$-$C_{22}$ alkyl group and M is a salt-forming cation.

Non-ionic surfactants include, for example, alkoxylated alcohols, polyoxyalkylene alkyl ethers (e.g., those marketed under the trade name Pluronic™ (e.g., Pluronic™ PE or Pluronic™ RPE, commercially available from BASF), polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and/or alkylamine oxides. In an exemplary embodiment, the non-ionic surfactant is an alcohol ethoxylate (AE).

The AE may be a primary or a secondary alcohol ethoxylate. In an exemplary embodiment, the AE is a primary or a secondary alcohol ethoxylate such as a $C_8$-$C_{20}$ aliphatic alcohol(s) ethoxylated with an average of from 1 to 20 moles of ethylene oxide per mole of alcohol, for example, a $C_{10}$-$C_{15}$ primary and secondary aliphatic alcohol(s) ethoxylated with an average of from 1 to 10 moles, such as with an average of from 3 to 8 moles of ethylene oxide per mole of alcohol.

In an exemplary embodiment, the AE is a condensation product of aliphatic $C_8$-$C_{20}$, such as $C_8$-$C_{16}$, primary or secondary, linear or branched chain alcohols with ethylene oxide. In an exemplary embodiment, the alcohol ethoxylates contain 1 to 20, such as 3 to 8 ethylene oxide groups, and may optionally be end-capped by a hydroxylated alkyl group.

In an exemplary embodiment, the AE is a compound having Formula (III):

$$R_3—(—O—C_2H_4-)_m—OH \qquad \text{Formula (III)},$$

wherein $R_3$ is a hydrocarbyl group having 8 to 16 carbon atoms, such as 8 to 14 carbon atoms, for example, 8 to 12 carbon atoms, such as 8 to 10 carbon atoms; and m is an integer from 1 to 20, such as from 3 to 8.

The hydrocarbyl group may be linear or branched, and saturated or unsaturated. In an exemplary embodiment, $R_3$ is a linear or branched $C_8$-$C_{16}$ alkyl group or a linear or branched $C_8$-$C_{16}$ alkenyl group. In an exemplary embodiment, $R_3$ is a linear or branched $C_8$-$C_{16}$ alkyl group, such as a $C_8$-$C_{14}$ alkyl group, for example, a $C_8$-$C_{10}$ alkyl group. In cases (e.g., commercially available materials) where materials contain a range of carbon chain lengths, these carbon numbers represent an average. The alcohol may be derived from natural or synthetic feedstock. In an exemplary embodiment, the alcohol feedstock is coconut, containing predominantly $C_{12}$-$C_{14}$ alcohol, and oxo $C_{12}$-$C_{15}$ alcohols.

In an exemplary embodiment, the detergent composition includes at least one fatty acid. In an exemplary embodiment, the fatty acid is present in an amount of from about 0.1 wt. % to about 3 wt. %, such as from about 1.5 wt. % to about 2.5 wt. % of the detergent composition. As used herein, the term "about" refers to a value within manufacturing/production tolerances, for example, within +/−10%, such as within +/−5%, for example, within +/−2% of the recited value.

In an exemplary embodiment, the fatty acid is a compound having Formula (IV):

$$R_4—C(O)OH \qquad \text{Formula (IV)},$$

wherein $R_4$ is a $C_5$-$C_{21}$ linear or branched aliphatic group. In an exemplary embodiment, $R_4$ is a $C_{13}$-$C_{21}$ linear or branched aliphatic group.

In an exemplary embodiment, the fatty acid is hexanoic acid, heptanoic acid, octanoic acid, nonanoic acid, capric acid, undecanoic acid, dodecanoic acid (lauric acid), tridecanoic acid, myristic acid, pentadecanoic acid, palmitic acid, heptadecanoic acid, stearic acid, nonadecanoic acid, eicosanoic acid, heneicosanoic acid, docosanoic acid, myristoleic acid, palmitoleic acid, sapienic acid, oleic acid, elaidic acid, vaccenic acid, linoleic acid, linoelaidic acid, arachidonic acid, eicosapentaenoic acid, erucic acid, docosahexaenoic acid, or a mixture thereof. In an exemplary embodiment, the fatty acid is dodecanoic acid, also known as coconut oil fatty acid (CFA).

In an exemplary embodiment, the detergent composition includes at least one silicone. In an exemplary embodiment, the silicone is present in an amount of from about 0.005 wt. % to about 0.2 wt. %, such as from about 0.005 wt. % to about 0.05 wt. %, for example, from about 0.02 wt. % to about 0.05 wt. % of the detergent composition. The benefits of the silicone are discussed in further detail in the EXAMPLES further below. One category of suitable silicones includes DOWSIL™ AC-8066 Antifoam, which is commercially available from Dow Chemical Co. located in Midland, Mich., USA. In an exemplary embodiment, the silicone is selected from the group of polydimethylsiloxanes, dimethyl silicones, general silicones, and combinations thereof.

In an exemplary embodiment, the detergent composition includes one or more non-aqueous solvents. In one example, the non-aqueous solvent(s) includes or consists of polyethylene glycol (PEG), glycol ether, poloxamer, and/or reverse poloxamer. In an exemplary embodiment, the non-aqueous solvent(s) is free of propylene glycol and glycerin. In an exemplary embodiment, the non-aqueous solvent(s) is present in an amount of from about 5 wt. % to about 25 wt. %, such as from about 10 wt. % to about 20 wt. % of the detergent composition. In an exemplary embodiment, the detergent composition includes PEG. In an exemplary embodiment, PEG has an average molecular weight of from about 300 g/mol to about 600 g/mol. In one example, the detergent composition includes PEG-400.

The detergent composition also includes water. In an exemplary embodiment, water is present in an amount of from about 8 wt. % to about 25 wt. %, such as from about 5 wt. % to about 15 wt. % of the detergent composition.

The detergent composition may further include one or more additional additives non-limiting examples of additional additives include a neutralizing agent(s), a bitterant(s), an optical brightener(s), an anti-redeposition agent(s), a chelator(s), an enzyme(s), and/or a fragrance(s). A wide range of neutralizing agents can be used herein. For example, the neutralizing agent may include a citrate, a formate, and/or an amine (e.g., monoethanol amine). In an exemplary embodiment, the neutralizing agent is present in an amount of from about 1 to about 10 wt. %, such as from about 1 to about 8 wt. %, for example from about 1 to about 6 wt. % of the detergent composition.

Non-limiting examples of optical brighteners include stilbenes such as TINOPAL™ AMS, distyrylbiphenyl derivatives such as TINOPAL™ CBS-X, stilbene/naphthotriazole blends (e.g., TINOPAL™ RA-16, commercially available from Ciba Geigy); oxazole derivatives, and coumarin brighteners. In an exemplary embodiment, the optical brightener(s) is present in an amount of from about X to about Y of the detergent composition. In an exemplary embodiment, the optical brightener is present in an amount of from about 0.01 to about 0.5 wt. % of the detergent composition.

Non-limiting examples of anti-redeposition agents include polycarboxylate materials. Polycarboxylate materials can be prepared by polymerizing or copolymerizing suitable unsaturated monomers and are admixed in their acid form. In an exemplary embodiment, unsaturated monomeric acids that can be polymerized to form polycarboxylates include, for example, acrylic acid, maleic acid (or maleic anhydride), fumaric acid, itaconic acid, aconitic acid, mesaconic acid, citraconic acid and methylenemalonic acid. In an exemplary embodiment, the anti-redeposition agent is Sokalan® HP20 polymer, which is commercially available from BASF corporation. In an exemplary embodiment, the anti-redeposition agent(s) is present in an amount of from about X to about Y of the detergent composition. In an exemplary embodiment, the anti-redeposition agent is present in an amount of from about 0.3 to about 6 wt. % of the detergent composition.

Chelators bind and remove calcium, magnesium, and/or other metals from water. Non-limiting examples of chelators include ethylenediaminetetraacetic acid (EDTA), nitrilotriacetic acid, diethylenetriaminepenta(methylenephosphonic acid), nitrilotris(methylenephosphonic acid), and 1-hydroxyethane-1,1-diphosphonic acid, iminodisuccinic acid (IDS). In an exemplary embodiment, the chelator is iminodisuccinic acid. In an exemplary embodiment, the chelator(s) is present in an amount of from about X to about Y of the detergent composition. In an exemplary embodiment, the chelator is present in an amount of from about 0.02 to about 1 wt. % of the detergent composition.

Suitable enzymes include those known in the art, such as amylolytic, proteolytic, cellulolytic or lipolytic type. In an exemplary embodiment, the protease, sold under the trade name SAVINASE™ by Novo Nordisk Industries A/S, is a subtillase from *Bacillus lentus*. Other suitable enzymes include proteases, amylases, lipases and cellulases, such as ALCALASE™ (bacterial protease), EVERLASE™ (protein-engineered variant of SAVINASE™), ESPERASE™ (bacterial protease), LIPOLASE™ (fungal lipase), LIPOLASE ULTRA (Protein-engineered variant of LIPOLASE), LIPOPRIME™ (protein-engineered variant of LIPOLASE), TERMAMYL™ (bacterial amylase), BAN (Bacterial Amylase Novo), CELLUZYME™ (fungal enzyme), and CAREZYME™ (monocomponent cellulase), sold by Novo Nordisk Industries A/S. Also suitable for use in the present disclosure are blends of two or more of these enzymes, for example a protease/lipase blend, a protease/amylase blend, a protease/amylase/lipase blend, and the like. In an exemplary embodiment, the enzyme(s) is present in an amount of from about X to about Y of the detergent composition. In an exemplary embodiment, the enzyme is present in an active enzyme solution which is present in an amount of from about 0 to about 0.5 wt. %, for example from about 0.001 to about 0.5 wt. % of the detergent composition, assuming the enzyme is present in the active enzyme solution in an amount of about 8 wt. % of the active enzyme solution.

Fragrances (e.g., perfumes or the like) refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. The fragrance can include an ester, an ether, an aldehyde, a ketone, an alcohol, a hydrocarbon, or a mixture thereof. In an exemplary embodiment, the fragrance(s) is present in an amount of from about X to about Y of the detergent composition. In an exemplary embodiment, the fragrance is present in an amount of from about 0 to about 2.5 wt. %, for example from about 0.001 to about 2.5 wt. % of the detergent composition.

In an exemplary embodiment, the unit dose detergent pack has a container that contains or otherwise encapsulates the detergent composition as discussed above. The unit dose detergent pack may be a pouch that includes a water-soluble or water-dispersible film that, for example, fully encloses the detergent composition in at least one compartment. The container (e.g., pouch) of the present disclosure may be in any desirable shape and/or size, e.g., square, rectangular, oval, elliptoid, superelliptical, or circular shape.

The container is made from a water-soluble or water-dispersible material which dissolves, ruptures, disperses, or disintegrates upon contact with water, thereby releasing the detergent composition contained in the container. In an exemplary embodiment, the container is a single-compartment container, which may be in the form of a pouch, and is formed from a water-soluble polymer. Non-limiting examples of water soluble polymers include polyvinyl alcohol, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, and mixtures thereof.

In an exemplary embodiment, the water-soluble or water-dispersible film material includes polyvinyl alcohol (PVOH), polyvinyl acetate (PVA), film forming cellulosic polymer, polyacrylic acid, polyacrylamide, polyanhydride, polysaccharide, or a mixture thereof. In an exemplary embodiment, the water-soluble or water-dispersible film material is polyvinyl alcohol (PVOH) or polyvinyl acetate (PVA). In an exemplary embodiment, the container is made from a lower molecular weight water-soluble polyvinyl alcohol (PVOH) film-forming resin.

In an exemplary embodiment, the container further include a cross-linking agent, e.g., a cross-linking agent selected from the group of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane (styrenes, methylmetacrylates), n-diazopyruvates, phenylboronic acids, cis-platin, divinylbenzene (styrenes, double bonds), polyamides, dialdehydes, triallyl cyanurates, N-(2-ethanesulfonylethyl)pyridinium halides, tetraalkyltitanates, titanates, borates, zireonates, or mixtures thereof. In an exemplary embodiment, the cross-linking agent is boric acid or sodium borate.

In an exemplary embodiment, the container includes a protective layer between the film polymer and the detergent composition. In an exemplary embodiment, the protective layer includes polytetrafluoroethylene (PTFE).

In an exemplary embodiment, the water-soluble or water-dispersible film material is from about 50 microns to about 120 microns thick, such as from about 60 microns to about 100 microns. In an exemplary embodiment, the water-soluble or water-dispersible film material has a thickness of from about 50 microns to about 120 microns, from about 50 microns to about 100 microns, from about 50 microns to about 80 microns, from about 50 microns to about 60 microns, from about 60 microns to about 120 microns, from about 60 to about 100 microns, from about 60 to about 80 microns, or from about 60 to about 70 microns.

The unit dose detergent pack may optionally include additional compartments, which may include an additional composition. The additional composition may be liquid, solid, or mixtures thereof. Alternatively, any additional solid components may be suspended in a liquid-filled compartment. Each compartment may have the same or different compositions.

The detergent composition or unit dose detergent pack can be added to a wash liquor to which laundry is present, or to which laundry is added. It may be used in combination with other laundry detergent compositions such as fabric softeners or stain removers. It may also be used in an automatic washing machine operation and added directly to the drum or to the dispenser drawer.

In an exemplary embodiment, the unit dose detergent pack is substantially free of efflorescence. Efflorescence is a phenomenon when solvated salts precipitate out on or in the film.

The following examples are illustrative and non-limiting, of the device, products and methods of the present disclosure. Suitable modifications and adaptations of the variety of conditions, formulations and other parameters normally encountered in the field and which are obvious to those skilled in the art in view of this disclosure are within the spirit and scope of the invention.

EXAMPLES

The following examples are provided for illustration purposes only and are not meant to limit the various embodiments of the present disclosure in any way.

TABLE 1

| Formula | Fatty Acid: CFA (wt. %) | Silicone (wt. %) | Foam Height (cm) | Foam Break (cm/min) | Foam Height to Foam Break Ratio (min) |
|---|---|---|---|---|---|
| 1 | 2 | 0 | 8.4 | 4.19 | 2.013 |
| 2 | 2 | 0.02 | 7.65 | 6.86 | 1.117 |
| 3 | 4 | 0 | 3.6 | 7.06 | 0.526 |
| 4 | 10 | 0 | 1.4 | 4.55 | 0.317 |
| 5 | 10 | 0 | 6.63 | 6.41 | 1.03 |

Referring to TABLE 1 and FIG. 1, data corresponding to de-foaming performance is provided. TABLE 1 provides 5 formulations for detergent compositions with varying proportions of fatty acid and silicone. The formulations were tested to provide data on foam height, foam break, and foam height to foam break ratio, as shown in TABLE 1. 1 liter of water was loaded into a 14.5 inch tall, 5.5 inch diameter cylinder and a proportional amount of detergent was added to the water (about 0.3 grams of detergent; assumes 20 grams of detergent goes into a full-scale washer that has about 65 liters of water in the basin). An x-shaped propeller blade that is 1 inch in diameter was spun at 2000 rpm for 30 seconds, generating foam. After the blade finished spinning, the height of the foam was recorded and then the time for the foam height to fall below 1 cm was recorded to calculate the foam break ratio: cm of foam depleted per minute. FIG. 1 provides a bar graph representation of the foam height to foam break ratio for formulations 1-5 as shown in TABLE 1. The foam height to foam break ratio represents de-foaming performance of the detergent composition. Formula 4 and Formula 5 provide the respective lower and upper boundary of de-foaming performance desired for detergent compositions provided herein. In an exemplary embodiment, the foam height to foam break ratio desired for the detergent composition is from about 0.317 minutes to about 1.03 minutes. Formula 3 provides a reduced amount of fatty acid and tested within the boundaries for desired de-foaming performance. Formula 2 provides a further reduction in fatty acid with the addition of silicone and tested about within the boundaries for desired de-foaming performance. Formula 1 provides the reduced amount of fatty acid as in Formula 2 without the silicone and tested outside the boundaries for desired de-foaming performance. This example shows that heavily reducing the amount of fatty acid will not provide the desired de-foaming performance without the addition of silicone.

TABLE 2

| Component | Weight Make-up in the Detergent Composition (wt. %) |
|---|---|
| C12-C15 Alcohol Ethoxylate 7EO | 23.074 |
| Glycerin | 20.048 |
| Propylene Glycol | 8.206 |
| MEA | 1.330 |
| LAS | 5.000 |
| Zeolite Water | 4.567 |
| Coconut Oil Fatty Acid | 2.000 |
| Sodium C12-C14 Alcohol Ethoxy sulfate 3EO (AES) | 26.000 |

TABLE 2-continued

| Component | Weight Make-up in the Detergent Composition (wt. %) |
|---|---|
| Bitrex | 0.050 |
| Tinopal CBS-X Swiss | 0.200 |
| Sokalan HP20 Polymer | 6.000 |
| Iminodisuccinic Acid | 0.900 |
| Enzyme: HET Regular | 0.625 |
| Subtotal | 98.000 |

Referring to TABLE 2, a base formulation for a detergent composition is provided. The base formulation is a 98 wt. % base for the detergent composition formulations as will be discussed in further detail below. The base formulation includes no silicone and 2 wt. % CFA as fatty acid.

TABLE 3

| Formula | Silicone: AC-8066 Dow Corning (wt. %) | Additional Glycerin | Light Transmission from LUMiSizer (%) | Visual Appearance (Naked Eye) |
|---|---|---|---|---|
| A | 0 | 2 | 88 | Transparent |
| B | 0.02 | 1.98 | 84 | Transparent |
| C | 0.05 | 1.95 | 80 | Transparent |
| D | 0.1 | 1.9 | 75 | Turbid |
| E | 0.2 | 1.8 | 65 | Turbid |
| F | 0.5 | 1.5 | 45 | Turbid |
| G | 0.75 | 1.25 | 38 | Turbid |
| H | 1 | 1 | 32 | Turbid |

Referring also to TABLE 3 and FIGS. 2A-2H, data corresponding to detergent composition turbidity is provided. TABLE 3 provides formulations A-H, which include the base formulation as shown in TABLE 2 and further include various proportions of silicone and glycerin amounting to 2 wt. % to achieve a 100 wt. % total of the detergent composition as shown in TABLE 3. TABLE 3 provides light transmission data as a quantitative measurement of turbidity as well as visual appearance data as a qualitative measurement of turbidity. Percent light transmission measures the proportion of light at specific wavelengths that can pass through a sample. About 1.5 mL of liquid was loaded into 10 mm polyamide synthetic cells (manufactured by LUM, cell 110-135xx) then placed into a LUMiSizer 12-channel instrument and spun at 500 rpm for 100 seconds, with a light factor of 1.0 and a 10 second time intervals between each measurement. Using the SEPview 6 software, the light transmission value for the first measurement was read between 117 nm to 125 nm. The light transmission data for Formulas A-H are represented graphically in FIGS. 2A-2H, respectively. Formula A provides a detergent composition with no silicone as a base comparison for alternate formulations. Formula A passes the test for turbidity, as it is transparent. Formula B provides a detergent composition with about 0.02 wt. % silicone that passes the test for turbidity. Formula C provides a detergent composition with about 0.05 wt. % silicone that passes the test for turbidity. Formula D provides a detergent composition with about 0.1 wt. % silicone and does not pass the test for turbidity, as it is relatively turbid. Formulas E-H have higher proportions of silicone than Formula D, and all do not pass the test for turbidity, as they are all relatively turbid. These examples show that the proportion of silicone in the detergent composition can be increased to a certain amount, beyond which the detergent composition becomes relatively turbid.

TABLE 4

| Formula | Additional Silicone: AC-8066 Dow Corning (wt. %) | Additional Glycerin | Separation Index (LUMiSizer) |
|---|---|---|---|
| A | 0 | 2 | 0.22 |
| B | 0.02 | 1.98 | 0.384 |
| C | 0.05 | 1.95 | 0.472 |
| D | 0.1 | 1.9 | 0.513 |
| E | 0.2 | 1.8 | 0.648 |
| F | 0.5 | 1.5 | 0.733 |
| G | 0.75 | 1.25 | 0.782 |
| H | 1 | 1 | 0.805 |

Figure 3:
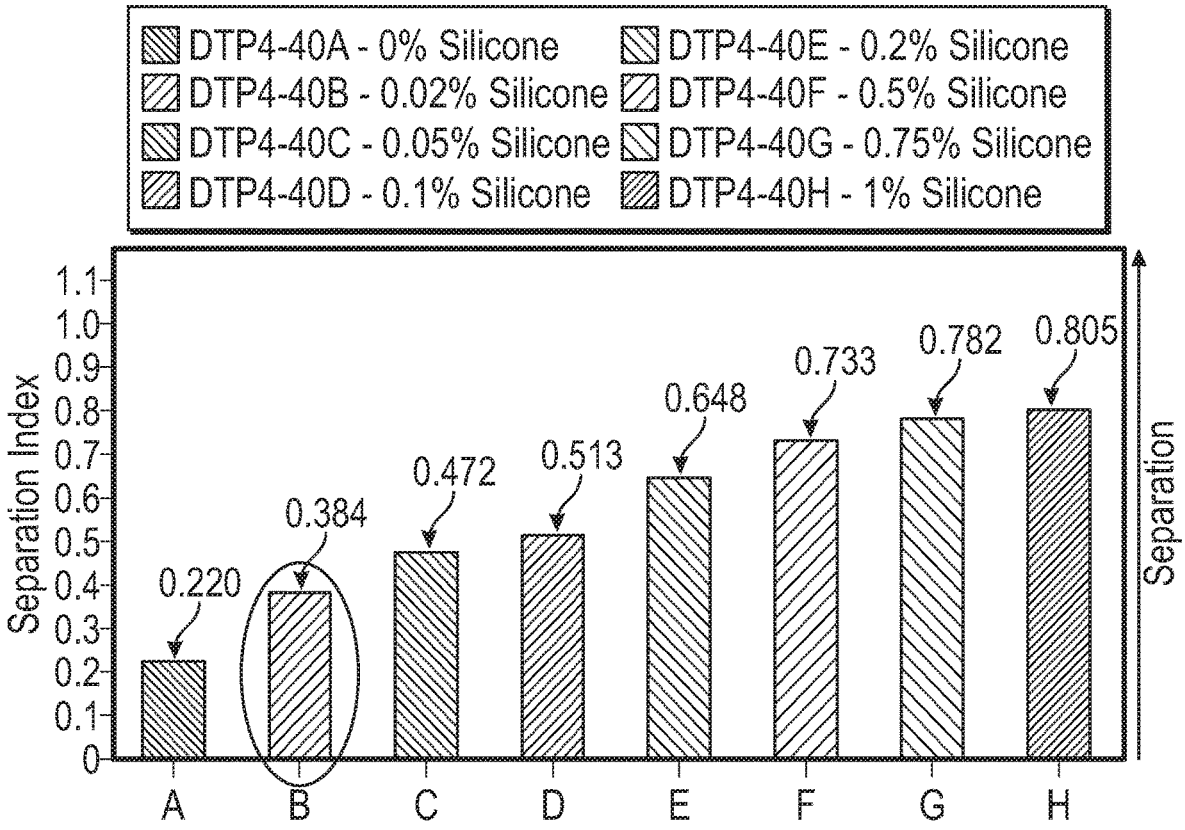
FIG. 3 illustrates a graphical representation of separation index data for various detergent compositions in accordance with exemplary embodiments.

Referring also to TABLE 4 and FIG. 3, data corresponding to detergent composition separation is provided. TABLE 4 provides formulations A-H, which are the same as formulations A-H in TABLE 3. In other words, formulations A-H in TABLE 4 include the base formulation as shown in TABLE 2 and further include various proportions of silicone and glycerin amounting to 2 wt. % to achieve a 100 wt. % total of the detergent composition as shown in TABLE 3 and TABLE 4. TABLE 4 provides separation index data as a quantitative measurement of separation of Formulas A-H. A separation of 1.0, for example, indicates that a sample has completely separated (i.e. 100% separation) while a separation of 0.35, for example, indicates that the sample has separated 35%. About 1.5 mL of liquid was loaded into 10 mm polyamide synthetic cells (manufactured by LUM, cell 110-135xx) then placed into a LUMiSizer 12-channel instrument and spun at 500 rpm for 100 seconds and then 3000 rpm for 4500 seconds, with a light factor of 1.0 and a 10 second time intervals between each measurement for 500 rpms and a 90 second time intervals between each measurement for 3000 rpms. Using the SEPview 6 software, the light transmission value for the first measurement versus the 4 hour (14,400 second) measurement was read between 113.8 nm to 130.1 nm. Based on a 92% reference light transmission value (the amount of light that would pass through a 10 mm polyamide synthetic cell filled with water), the software calculated each separation index value (between 0 and 1.0; with 1.0 being 100% separated). The separation index data for Formulas A-H are represented graphically by FIG. 3. Formulas A-C have a degree of separation in the desired range and Formulas D-H have a degree of separation outside the desired range. These examples show that as the proportion of silicone in the detergent composition is increased, the separation of the detergent composition also increases. The degree of separation of the detergent composition is relevant because higher degrees of separation result in turbidity and instability in the detergent composition.

TABLE 5

| Component | Comparative Formula 1 | Comparative Formula 2 | Comparative Formula 3 | Exemplary Formula 4 |
|---|---|---|---|---|
| C12-C15 Alcohol Ethoxylate 7EO | 23.074 | 23.074 | 23.074 | 23.074 |

TABLE 5-continued

| Component | Comparative Formula 1 | Comparative Formula 2 | Comparative Formula 3 | Exemplary Formula 4 |
|---|---|---|---|---|
| Glycerin | 13.128 | 16.058 | 11.950 | 11.950 |
| Propylene Glycol | 8.206 | 8.206 | — | — |
| MEA | 3.150 | 2.220 | 1.750 | 1.750 |
| LAS | 5.000 | 5.000 | 5.000 | 5.000 |
| Zeolite Water | 4.567 | 4.567 | 10.000 | 10.000 |
| Coconut Oil Fatty Acid | 10.000 | 8.000 | 4.000 | 2.000 |
| Silicone | — | — | — | 0.020 |
| Sodium C12-C14 Alcohol Ethoxy sulfate 3EO (AES) | 26.000 | 26.000 | 26.000 | 26.000 |
| Bitrex | 0.050 | 0.050 | 0.050 | 0.050 |
| Tinopal CBS-X Swiss | 0.200 | 0.200 | 0.200 | 0.200 |
| Sokalan HP20 Polymer | 6.000 | 6.000 | 6.000 | 6.000 |
| Iminodisuccinic Acid | — | — | — | — |
| Enzyme: HET Regular | 0.625 | 0.625 | 0.625 | 0.625 |
| PEG-400 | — | — | 11.351 | 13.331 |
| Subtotal | 100.000 | 100.000 | 100.000 | 100.000 |
| Film/Liquid Stability at 75 F., 20 g of liquid into 75 micron thick single-chamber packs | Stable | Unstable (efflorescence within 2 days) | Stable | Stable |

Referring to TABLE 5, formulations for detergent compositions are provided. Comparative Formulas 1-3 are detergent compositions that do not include silicone and are provided as comparative formulas to Exemplary Formula 4. Notably, Exemplary Formula 4 includes coconut oil fatty acid present in an amount of about 2 wt. % and silicone present in an amount of about 0.02 wt. % of the detergent composition. As discussed above, decreasing the amount of fatty acid to 2 wt. % without the addition of silicone, results in a detergent composition with de-foaming performance outside the desired range. However, with the addition of silicone as in Exemplary Formula 4, the de-foaming performance of the detergent composition is in the desired range. Additionally, the proportion of silicone in Exemplary Formula 4 is relatively low so as to produce desirable results with respect to the stability, separation, and/or turbidity of the detergent composition.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A detergent composition comprising:

at least one surfactant, wherein the at least one surfactant comprises non-ionic surfactant present in an amount of about 23 wt. % of the composition;

a fatty acid present in an amount of from about 0.1 wt. % to about 3 wt. % of the detergent composition;

a silicone present in an amount of from about 0.005 wt. % to about 0.05 wt. % of the detergent composition;

one or more non-aqueous solvents selected from the group of polyethylene glycol (PEG), glycol ether, poloxamer, and reverse poloxamer, wherein the one or more non-aqueous solvents is present in an amount of from about 5 wt. % to about 25 wt. % of the detergent composition; and water present in an amount of from about 8 wt. % to about 25 wt. % of the detergent composition.

2. The detergent composition of claim 1, wherein the fatty acid is present in an amount of from about 1.5 wt. % to about 2.5 wt. % of the detergent composition.

3. The detergent composition of claim 1, wherein the one or more non-aqueous solvents is present in an amount of from about 10 wt. % to about 20 wt. % of the detergent composition.

4. The detergent composition of claim 1, wherein water is present in an amount of from about 5 wt. % to about 15 wt. % of the detergent composition.

5. The detergent composition of claim 1, wherein the fatty acid is coconut oil fatty acid.

6. The detergent composition of claim 1, wherein the detergent composition includes one or more additives selected from the group of a neutralizing agent(s), a bitterant(s), an optical brightener(s), an anti-redeposition agent(s), a chelator(s), an enzyme(s), and a fragrance(s).

7. The detergent composition of claim 6, wherein the one or more additives includes the enzyme(s).

8. The detergent composition of claim 1, wherein the one or more non-aqueous solvents includes PEG.

9. The detergent composition of claim 8, wherein PEG has a molecular weight of from about 300 g/mol to about 600 g/mol.

10. The detergent composition of claim 9, wherein PEG is PEG-400.

11. The detergent composition of claim 1, wherein the fatty acid is present in an amount of from about 1.5 wt. % to about 2.5 wt. % of the detergent composition, wherein the one or more non-aqueous solvents is present in an amount of from about 10 wt. % to about 20 wt. % of the detergent composition, and wherein water is present in an amount of from about 5 wt. % to about 15 wt. % of the detergent composition.

12. A unit dose detergent pack comprising:

a container formed of a water-soluble and/or water-dispersible material; and a detergent composition disposed in the container, wherein the detergent composition comprises:

at least one surfactant, wherein the at least one surfactant comprises non-ionic surfactant present in an amount of about 23 wt. % of the composition;

a fatty acid present in an amount of from about 0.1 wt. % to about 3 wt. % of the detergent composition;

a silicone present in an amount of from about 0.005 wt. % to about 0.05 wt. % of the detergent composition;

one or more non-aqueous solvents selected from the group of polyethylene glycol (PEG), glycol ether, poloxamer, and reverse poloxamer, wherein the one or more non-aqueous solvents is present in an amount of from about 5 wt. % to about 25 wt. % of the detergent composition; and water present in an amount of from about 8 wt. % to about 25 wt. % of the detergent composition.

13. The detergent composition of claim 1, wherein the detergent composition has an average light transmission of more than about 75% between about 117 nm and about 125 nm.

14. The unit dose detergent pack of claim 12, wherein:

the fatty acid is present in an amount of from about 1.5 wt. % to about 2.5 wt. % of the detergent composition;

the one or more aqueous solvents is present in an amount of from about 10 wt. % to about 20 wt. % of the detergent composition; and water is present in an amount of from about 5 wt. % to about 15 wt. % of the detergent composition.

15. The unit dose detergent pack of claim 12, wherein the fatty acid is coconut oil fatty acid.

16. The unit dose detergent pack of claim 12, wherein the detergent composition includes one or more additives selected from the group of a neutralizing agent(s), a bitterant (s), an optical brightener(s), an anti-redeposition agent(s), a chelator(s), an enzyme(s), and a fragrance(s).

17. The unit dose detergent pack of claim 16, wherein the one or more additives includes the enzyme(s).

18. The unit dose detergent pack of claim 12, wherein the one or more non-aqueous solvents includes PEG.

19. The unit dose detergent pack of claim 18, wherein PEG has a molecular weight of from about 300 g/mol to about 600 g/mol.

20. The unit dose detergent pack of claim 19, wherein PEG is PEG-400.

* * * * *